US005191169A

United States Patent [19]

Hu

[11] Patent Number: 5,191,169

[45] Date of Patent: Mar. 2, 1993

[54] MULTIPLE EFP CLUSTER MODULE WARHEAD

[75] Inventor: John B. Hu, Yorbalinda, Calif.

[73] Assignee: Olin Corporation, Cheshire, Conn.

[21] Appl. No.: 812,340

[22] Filed: Dec. 23, 1991

[51] Int. Cl.[5] ..... F42B 12/10; F42B 12/18

[52] U.S. Cl. ..... 102/476; 102/480; 102/489; 102/491

[58] Field of Search ..... 102/306-310, 102/383, 393, 476, 480, 489, 491, 493, 494, 495, 496, 497

[56] References Cited

U.S. PATENT DOCUMENTS

| | | | |
|---|---|---|---|
| 1,129,696 | 2/1915 | Labemat | 102/480 |
| 2,984,307 | 5/1961 | Barnes | 102/307 |
| 3,013,491 | 12/1961 | Poulter | 102/310 |
| 3,347,164 | 10/1967 | Baks et al. | 102/310 |
| 3,998,162 | 12/1976 | Forrest et al. | 102/476 |
| 4,175,491 | 11/1979 | Thomanek . | |
| 4,974,515 | 12/1990 | Busch et al. . | |

FOREIGN PATENT DOCUMENTS

| | | | |
|---|---|---|---|
| 2526416 | 10/1985 | Fed. Rep. of Germany | 102/476 |
| 1432578 | 2/1966 | France | 102/476 |
| 89303 | 6/1967 | France | 102/476 |
| 2472168 | 6/1981 | France | 102/489 |

*Primary Examiner*—Harold J. Tudor

*Attorney, Agent, or Firm*—Bruce E. Burdick

[57] ABSTRACT

A multiple module EFP warhead comprises a tubular body having a central axis with a plurality of explosively formed penetrator modules arranged tandemly within the body along the axis. Each of the modules includes a curved, dish shaped support disk having a unique forwardly convex curvature. The support disk is focused on the axis at a point behind the module. Each module has a set of circumferentially spaced apertures therethrough, each having a central aperture axis intersecting the central axis. Each aperture supports a separate ductile metal disk therein and an explosive charge behind and against the metal disk. Each of the aperture axes forms an acute angle of inclination with the central axis which is uniquely offset from the axes of the other modules so that each EFP travels along a unique forward path.

18 Claims, 2 Drawing Sheets

| LEGEND | DISPERSION PATTERN AT 400' RANGE | | | | | | | | | | | |
|---|---|---|---|---|---|---|---|---|---|---|---|---|
| SYM | ○ | △ | □ | ▽ | ⬡ | ◇ | ⬠ | ⬡ | ⬯ | ◺ | ◺ | ✠ |
| α | 0° | 30° | 15° | 0° | 45° | 30° | 0° | 15° | 45° | 30° | 0° | 15° |
| θ | .3° | .4° | .5° | .6° | .7° | .8° | .9° | 1.0° | 1.1° | 1.25° | 1.35° | 1.35° |
| EFP MOD | 1 | 2 | 3 | 4 | 5 | 6 | 7 | 8 | 9 | 10 | 11 | 12 |

MULTIPLE EFP CLUSTER MODULE WARHEAD

BACKGROUND OF THE INVENTION

This invention generally relates to warheads and more particularly to a multifunctional explosively formed penetrator (EFP) warhead for a missile or a gun fired projectile.

Small diameter missiles are typically on the order of 2.75 or 3 inches in diameter. Because of the small diameter, these missiles have not been provide a directed payload that can cover a wide range of lightly armored targets such as tanks, helicopters, personnel carriers and such.

One fragmentation warhead creating multiple EFP and designed for anti-tank use which is carried by a rocket is disclosed in U.S. Pat. No. 4,175,491. This warhead possesses a projectile forming mantel or surface covering. The warhead is detonated when the forward tip hits the ground. At this instant, the warhead is usually normal to the ground. The explosively formed penetrators are ejected radially outward in a 360° pattern tangent to the ground.

Another multiple EFP warhead design is disclosed in U.S. Pat. No. 4,974,515. This patent also discloses radial ejection of the EFPs in a 360° pattern to defeat nearby targets in a plane normal to the warhead axis.

These two designs are designed to defeat ground targets as they are detonated when the warhead reaches approximately the same planar surface which supports the target. They are not effective against airborne or floating targets such as helicopters and shipping and they are not aimable.

SUMMARY OF THE INVENTION

The present invention is an aimable EFP warhead which ejects a plurality of EFPs in a generally forward direction in a pattern somewhat analogous to the pattern of shot from a shotshell. However, in the present invention, the dispersion pattern is more precisely determined and can be tailored to the specific targets to be attacked.

The warhead of the present invention has a plurality of explosively formed penetrator modules arranged tandemly one behind the other along the central axis of a tubular warhead body. Each of the modules contains a plurality of EFP liners and charges arranged in a support disk. The support disk is essentially a circular metal plate with a central axial bore. Multiple circumferentially spaced apertures or more preferably bores extend through the plate. Each of the circumferentially spaced bores has a unique bore axis that intersects the central axis. Each bore axis represents a different trajectory path forwardly along and diverging from the central axis. Each bore contains a ductile metal liner disk mounted transversely in the bore and an explosive charge behind the disk.

The liner disk is preferably copper and has a shallow forwardly concave dish shape so that, upon detonation of the explosive charge, the disk forms a compact rearwardly folding EFP, i.e. a ball penetrator which is accelerated forwardly along its individual bore axis.

Each of the modules has its circumferential bore axes inclined at a different angle with respect to the longitudinal axis of the warhead so that the EFPs generated upon detonation follow unique forward paths. For example, the forward most module circumferential bores each form an angle Theta ($\theta$) with respect to the Normal to the longitudinal axis of 0.3°. Each sequentially rearward module has a progressively larger angle theta. Thus modules 1, 2, 3, and 4 have Theta angles of 0.3°, 0.4°, 0.5° and 0.6° respectively. In addition, each successively rearward module may also be rotated about the longitudinal axis A by an angle Alpha ($\alpha$), the twist angle, so that the net result is that each EFP is projected along a unique forward Path so as to produce a uniformly distributed EFP pattern downrange.

The superior penetration of ball shaped copper penetrators (EFPs) is substantially greater than that of shrapnel. The aimable multiple EFP pattern created by the warhead of the present invention greatly enhances the kill effectiveness of chemical energy warhead missile systems against a variety of armor, material, personnel, aircraft, and coastal shipping. These and other objects, features, and advantages of the invention will become apparent from a detailed reading of the accompanying detailed description and claims when taken in conjunction with the appended drawings.

DETAILED DESCRIPTION OF THE INVENTION

Figure 1:
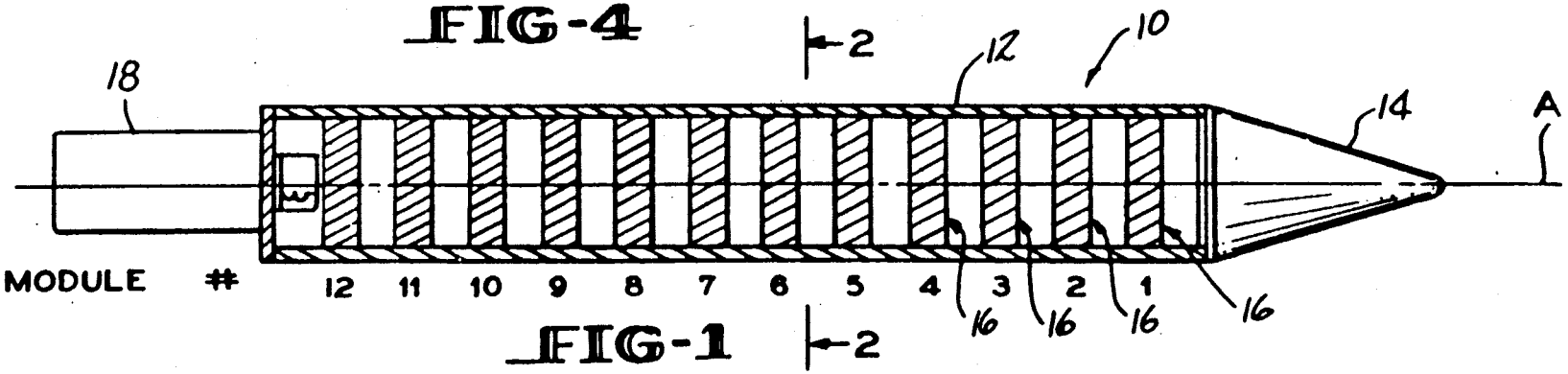
FIG. 1 is a schematic sectional side view of the warhead in accordance with the invention.

A warhead 10 in accordance with the invention is schematically illustrated in a side view in FIG. 1. Warhead 10 comprises a tubular body 12 symmetrical about a longitudinal axis A containing a plurality of EFP modules 16.

Tubular body 12 may be made of steel, aluminum, or other metal or plastic material. The tubular body 12 may also be backed by a layer of Detasheet explosive so as to form shrapnel fragments upon detonation of the warhead in addition to the EFPS as are herein described. The nose 14 is primarily a wind shield and therefore may be made of plastic or other light weight material. Behind tubular body 12 is a detonator system 18 of conventional design for sequentially controlling detonation of the axially spaced EFP modules 16.

The tubular body 12 contains a plurality of explosively formed penetrator (EFP) modules 16 axially spaced from one another and axially stacked tandemly along the longitudinal axis A. Each of the modules 16 include a support disk 20 having mounted therein a cluster of circumferentially spaced EFP devices 22. Each EFP device 22 includes a dish shaped metal liner 24, an explosive charge 26, and a detonator 28 which is in turn controlled via detonator system 18. Each EFP device 22 is housed in a bore 30 through the support disk 20. Each bore 30 has an axis B which intersects the longitudinal central axis A at an included acute angle Theta ($\theta$). Each of these axes B is unique with respect to the central axis A. The axes B are preferably symmetrically distributed about the circumference of the disk 20. For example, in the preferred embodiment illistrated in FIGS. 1 through 4, the axes B are angularly spaced 60° apart about axis A and inclined by angle theta from axis A. Each module 16 may also have a central axial bore 30 coaxial with axis A containing an EFP device 22.

Figure 3:
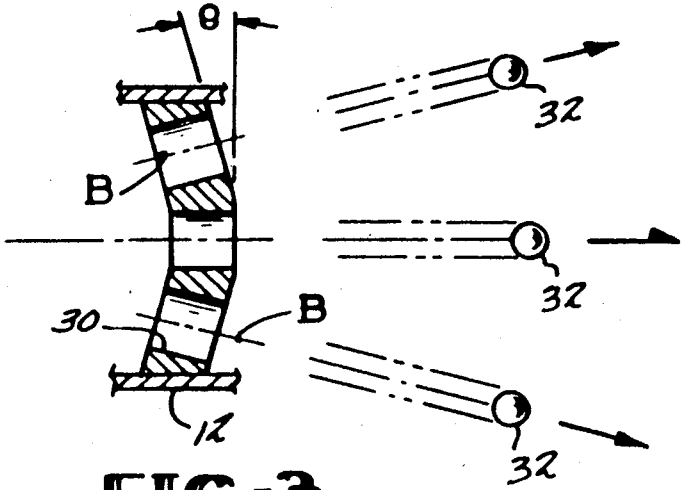
FIG. 3 is a partial sectional view of the warhead in FIG. 2 taken on the line 3—3.
Figure 2:
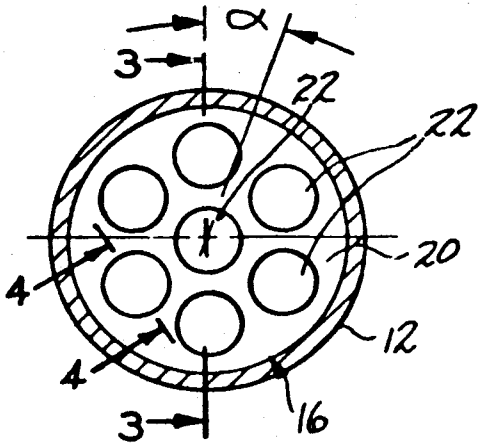
FIG. 2 is a sectional view of the warhead of the invention shown in FIG. 1 taken along the line 2—2.
Figure 4:
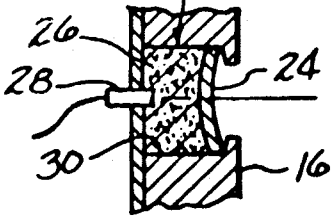
FIG. 4 is an enlarged partial sectional view of the module shown in FIG. 2 taken along the line 4—4.
Figures 5, 6:
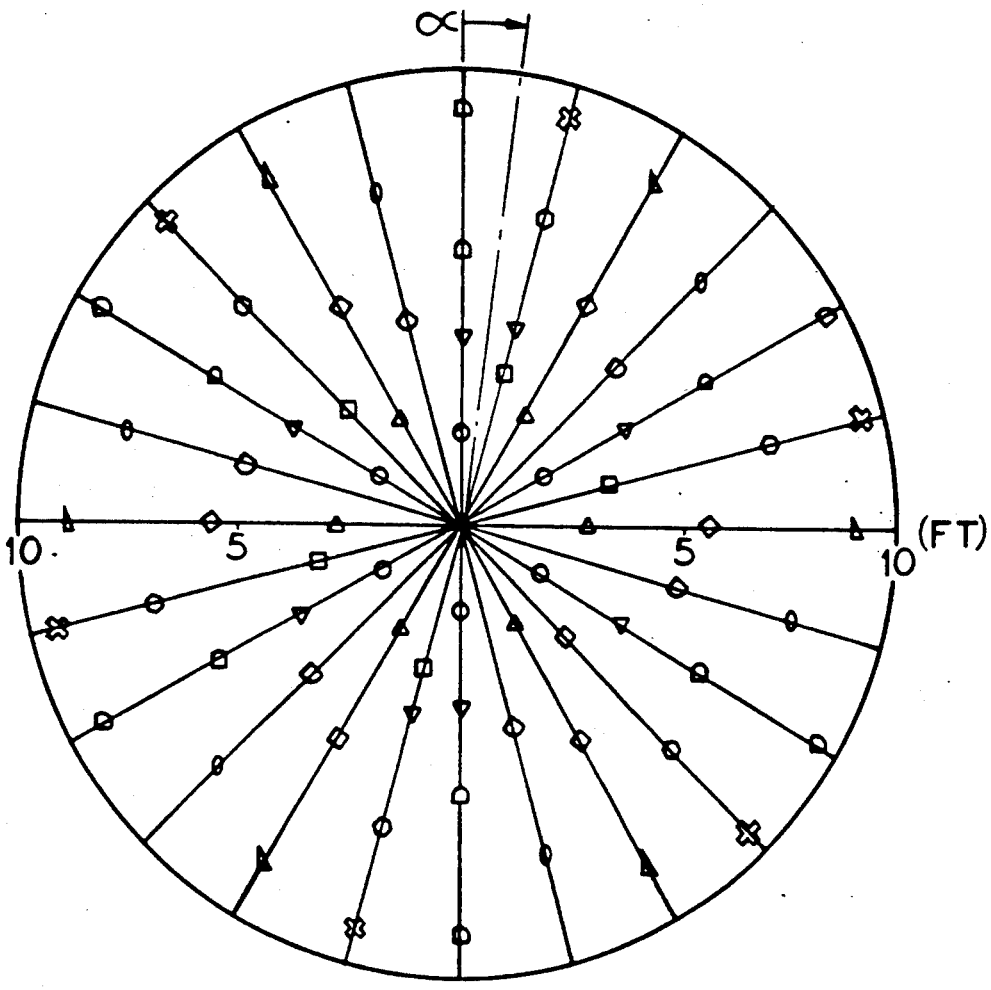
FIG. 5 is a diagram of the projected EFP dispersion pattern at a target range of approximately 400 feet created by the warhead shown in FIG. 1.
FIG. 6 is a legend of the dispersion pattern shown in FIG. 5 indicating the module from which a particular EFP originated.

Each of the circumferentially spaced bores 30 in the module 16 is inclined from the Normal to the longitudinal axis A, and thus also axis A, by an angle Theta as shown in FIG. 3. Each sequentially positioned module 16 has its circumferentially spaced bores 30 inclined at a different angle Theta which increases, preferably by about 0.1° in each succeedingly rearward module as indicated in FIG. 6. In addition, the circumferentially spaced bores 30 are twisted, or rotated, about the longitudinal axis A by an angle Alpha ($\alpha$) as shown in FIG. 2. This rotation ensures that each circumferential bore 30 is directed or aimed along a unique axis from any other module axis. The dispersion pattern of explosively formed projectiles 32 is as shown in FIG. 5 at a target distance of 400 feet for the example angles as listed in FIG. 6.

The detonator assembly 18 is designed to simultaneously ignite initiators 28 in each module in a known manner and preferably detonate each module in numerical sequence. The detonator assembly 18 is preferably selectable between impacting upon nose impact with or without delay, 4 to 6 foot proximity detonation, or after a launch time delay.

The tubular body 12 may have an outside layer of steel fragmentation casing which is backed by a thin inner layer of flexible explosive Detasheet. This can enhance the shrapnel production and enhance the anti-personnel effect. The explosive utilized in the EFP cluster may be any conventional explosive for shape charge devices or EFP such as LX-14 made by Holston Corporation. The liner 24 is preferably made of copper or tantaum. The support disks 20 may preferably be made of steel or other hard metal material.

The copper or tantalum liner 24 essentially forms ball shaped EFP penetrators 32 as shown in FIG. 3, upon detonation. The warhead illustrated in FIG. 1 of a total of 12 modules of EFP clusters for producing a circular pattern with a total of 84 EFPs. Each warhead module 16 is designed to explosively form a cluster of seven 60 grain ball shaped copper penetrators 32 each having an initial launch velocity of be about 2 to 3 kilometers per second. Such 60 grain copper penetrators 32 will be able to penetrate from 0.75 to 1.0 inch of rolled homogeneous armor (RHA) depending upon the designed terminal velocity of the penetrators. By orienting the flight path of the 6 peripheral EFPs of every leading module slightly different from that of the following modules, the dispersion pattern as shown in FIG. 5 is achieved.

It is believed the optimum penetrator design impact distance is around 400 feet. At this range, the 84 EFP projectiles, at the angles selected, form in evenly distributed pattern 20 feet in diameter with no EFP more than 2 feet from its adjacent penetrator.

While the present invention has been described above reference to particular embodiments thereon, it is apparent that many changes, modification, and variations can be made without departing from the inventive concept disclosed herein. Accordingly, it is intended to embrace all such changes, modifications, and variations that fall within the board scope of the appended claims. All patents, patent applications, and other publications cited herein are incorporated by reference in their entirety.

What is claimed is:

1. A warhead comprising:

a tubular body having a central axis and having a plurality of explosively formed penetrator modules all of said modules having substantially identical outer diameters and arranged tandemly within said body along said axis, each of said modules including a support disk having a set of circumferentially spaced bores therethrough, each of said bores having a central bore axis intersecting said central axis at an included acute angle, each bore having mounted therein a separate ductile metal disk, a separate explosive charge totally contained within said bore behind and against said metal disk, and an ignition means for said explosive charge, each of said bore axes being uniquely offset from each other so that each EFP travels along a unique forward path.

2. The warhead according to claim 1 wherein each explosive charge in each module bore contains a separate detonator.

3. The warhead according to claim 2 wherein each of said modules contains one bore coaxial with said central axis of said body and a plurality of circumferentially spaced bores about said coaxial aperture.

4. The warhead according to claim 3 wherein each module is axially spaced from an adjacent module by a gap.

5. The warhead according to claim 1 wherein the bore axes in each module have identical angles of inclination with respect to the central axis.

6. The warhead according to claim 5 wherein the angle of inclination in each module differs from module to module.

7. The warhead according to claim 6 wherein each module has an angle of inclination that is greater than the angle of inclination of the bore axes in the immediately forward module.

8. The warhead according to claim 1 wherein each module has its circumferentially spaced bores rotationally offset by a unique angle from the bores in a forwardmost module.

9. The warhead according to claim 1 further comprising a central selectively controlled detonating fuse to detonate the explosive charges to produce said EFPs at a predetermined distance from a target.

10. A warhead for a missile comprising:

a tubular body having a central axis and having a plurality of explosively formed penetrator modules, all of said modules having substantially identical outer diameters arranged tandemly within said body along said axis, each of said modules including a curved dish shaped support disk having a unique forwardly convex curvature focused on said axis at a point behind said module and a set of circumferentially spaced apertures therethrough, each of said apertures having a central aperture axis intersecting said central axis and each supporting a separate ductile metal disk therein and a separate explosive charge totally contained within said aperture behind and against said metal disk, each of said aperture axes forming an acute angle of inclination with said central axis and being uniquely offset from each other so that each EFP travels along a unique forward path.

11. The warhead according to claim 10 wherein each explosive charge in each module aperture contains a separate detonator.

12. The warhead according to claim 11 wherein each of said modules contains one coaxial aperture and six equidistantly spaced circumferential apertures about said coaxial aperture.

13. The warhead according to claim 12 wherein each module is axially spaced from an adjacent module by a gap.

14. The warhead according to claim 10 wherein the aperture axes in each module having identical angles of inclination with respect to the central axis.

15. The warhead according to claim 14 wherein the angle of inclination in each module differs from module to module.

16. The warhead according to claim 15 wherein each module has an angle of inclination that is greater than the angle of inclination of the aperture axes in the immediately forward module.

17. The warhead according to claim 15 wherein each module has its circumferentially spaced apertures rotationally offset by a unique angle from the apertures in a forwardmost module.

18. The warhead according to claim 15 further comprising a central selectively controlled detonating fuse to detonate the explosive charges to produce said EFPs at a predetermined distance from a target.

* * * * *